US006050402A

United States Patent [19]

Walter

[11] Patent Number: 6,050,402

[45] Date of Patent: Apr. 18, 2000

[54] SMOKING ARTICLE CARTON AND BLANK THEREFOR

[75] Inventor: Sidney John Walter, Addlestone, United Kingdom

[73] Assignee: British American Tobacco (Investments) Limited, Middlesex, United Kingdom

[21] Appl. No.: 09/101,862

[22] PCT Filed: Jan. 30, 1997

[86] PCT No.: PCT/GB97/00256

§ 371 Date: Jul. 17, 1998

§ 102(e) Date: Jul. 17, 1998

[87] PCT Pub. No.: WO97/29022

PCT Pub. Date: Aug. 14, 1997

[30] Foreign Application Priority Data

Feb. 8, 1996 [GB] United Kingdom ..... 9602540

[51] Int. Cl.[7] ..... A24F 15/00; B65D 5/72

[52] U.S. Cl. ..... 206/273; 206/273; 206/265; 206/268; 229/122.1; 229/122; 229/933; 229/207

[58] Field of Search ..... 229/122.1, 207, 229/210, 221, 122, 132, 136, 933, 935; 221/305, 302, 309, 312 B; 206/738, 265, 271, 273, 268

[56] References Cited

U.S. PATENT DOCUMENTS

| | | | |
|---|---|---|---|
| 1,585,494 | 5/1926 | Harvey | 229/122.1 |
| 1,935,905 | 1/1933 | Perryman | 221/309 X |
| 2,145,181 | 1/1939 | Kenedy | 229/122 |
| 2,162,089 | 6/1939 | Kagen | 229/122 |
| 2,228,181 | 1/1941 | Perryman | 229/122 |
| 2,325,277 | 7/1943 | Rothe et al. | 221/305 |
| 2,767,832 | 10/1956 | Silberman | 206/268 X |
| 3,335,933 | 8/1967 | Woodling | 229/122 |
| 3,749,300 | 7/1973 | Jones | 229/132 X |
| 3,884,350 | 5/1975 | Johansson | 229/122 |
| 4,396,143 | 8/1983 | Killy | 229/122 X |
| 4,493,453 | 1/1985 | LeDrew | 229/122.21 |
| 4,498,581 | 2/1985 | Dutcher | 229/122 |
| 4,577,799 | 3/1986 | Oliff | 229/122 X |
| 5,494,216 | 2/1996 | Van Suntenmaartensdijk | 229/210 X |

*Primary Examiner*—Gary E. Elkins
*Assistant Examiner*—Tri M. Mai
*Attorney, Agent, or Firm*—Pitney, Hardin, Kipp & Szuch, LLP

[57] ABSTRACT

This invention relates to an improved carton for smoking articles, which carton has a dispensing portion. The dispensing portion has a particular location in respect to the longitudinal margins of the carton and extends from a position short of one longitudinal side margin of the carton, across the panel thereof, through another longitudinal side margin of the carton and into another panel of the carton. The perforation line of the dispersion portion is particularly selected to provide added strength to the carton and to allow consequent economies in other enclosed packing materials.

21 Claims, 5 Drawing Sheets

SMOKING ARTICLE CARTON AND BLANK THEREFOR

This invention relates to the packaging provided for smoking articles, particularly but not exclusively cigarettes.

Recent EC regulations have been introduced which require the packaging manufacturer of consumer goods to use the minimum amount of board required to protect their goods. In the tobacco industry efforts are now being made to conform with these regulations. Presently, Applicant provides for the European market 10 packs of cigarettes, each pack containing 20 cigarettes, in a 5×2 column by row arrangement. There is thus provided packaging comprising a long rectangular 200's carton for surrounding 5 columns in 2 rows of 20's cigarette packs.

This invention has as an object the provision of an improved smoking article carton design over the above described arrangement.

Elsewhere in the world various types of cartons for smoking article packs of different sizes have been used. Some of these cartons provide a dispensing opening therein which enables individual packs to be removed from the carton without opening the whole carton. In these cartons the dispensing portion extends across two longitudinal margins.

It is an object of the present invention to provide an improved carton dispensing arrangement, which improvement provides increased carton strength and thereby allows consequent economies to be made in other smoking article packages, as desired. As used herein the term package covers a pack, carton, case or box, each of these terms having their usual tobacco industry meaning.

The present invention provides a smoking article carton blank comprising a first panel, a second panel, a first side panel, a second side panel, a side flap, and inner and outer top and bottom flaps, each panel being defined longitudinally by two longitudinal side margins, characterised in that there is provided a dispensing portion in said carton, which dispensing portion extends from a position short of one of the longitudinal side margins of one panel across the respective panel through the other longitudinal side margin of that panel into another panel.

Preferably each panel has a top margin and a bottom margin. Advantageously the first side panel depends from one of the longitudinal side margins of the first panel. Advantageously the second side panel depends from the other longitudinal side margin of the first panel and the second panel depends from the further longitudinal side margin of the second side panel. The side flap depends advantageously from the other longitudinal side margin of the second panel. This arrangement is preferred because the cut edge of one of the side panels is located towards the rear of the carton.

In the alternative, suitably the first and second side panels depend from each of the longitudinal side margins of the second panel. One of the side panels further depends from a longitudinal side margin of the first panel. The side flap depends from the other longitudinal side margin of the first panel.

Preferably the dispensing portion is located mainly in the first or second panel of the carton. In the alternative, the dispensing portion is located mainly in one of the side panels. In the first location, one side of one of the enclosed packs will be revealed by opening the dispensing portion, whilst in the other location either the top or bottom of an enclosed pack will be revealed by opening the dispensing portion.

The perforation line extending across the longitudinal margin can be cut or perforated there-across. Preferably the perforation line extends across the longitudinal margin without the margin actually having a cut or perforations there-across. In this way the margin is kept substantially intact, even though the area in close proximity thereto is cut or otherwise perforated.

Advantageously perforation across the longitudinal margin stops less than 5 mm and preferably less than 3 mm from either side of the margin. The actual distance from the margin at which perforation or cutting ceases will depend on the physical characteristics of the board selected for the carton.

Advantageously the position short of one of the longitudinal side margins is a position less than 10 mm from the other longitudinal margin, and is preferably less than about 5 mm from the other longitudinal margin.

Preferably the outer top flap and outer bottom flap are each located depending from the top margin and bottom margin respectively of the first panel. This is more advantageous, especially when the first panel is the panel to be facing the consumer, as the cut edges of the outer top and bottom flaps will then be located towards the rear of the carton. The outer top and bottom flaps can be disposed depending from the second panel, if desired.

Preferably a top inner flap and a bottom inner flap depends from each of the remaining respective top and bottom margins of the blank.

The present invention further provides a carton print layout for the carton of this invention, characterised in that the arrangement of carton blanks in the print layout provides more than 10% saving in board area over the present 200's standard compact carton print layout provided for an 84 mm long, 24.75 mm circumference smoking article.

Preferably the print layout provides more than 11% saving in board area of the print layout and suitably about 11.7% saving in board area over a 200's standard compact carton.

The present invention also provides a carton enclosing smoking article packs, the carton being provided from carton blank according to the invention, the board weight of each cigarette pack having been reduced as a consequence of the improved strength of the carton.

Preferably the cartonboard is a recycled board product. Such a cartonboard fulfills the E.U. Directive for packaging to increase the proportion of recycled material whilst maintaining at least minimum product protection without contravening Health and Safety requirements. Preferably the board for the smoking article packs is a non-recycled product. The advantage of this arrangement is that the improved strength of the carton, even though a recycled product, allows the packaging manufacturer to downweight the board of the inner packs, which use more expensive non-recycled board as the packaging material. This downweighting maximises the cost benefits to the manufacturer.

For a given strength requirement, the weight of the cartonboard can be either reduced, if non-recycled board is used, or increased, if recycled board is used, but at a lower cost for the same strength. Recycled board is generally heavier, at the present time, than non-recycled board but costs less for the heavier weight of board.

In order that the invention may be easily understood and readily carried into effect, reference will now be made, by way of example, to the accompanying diagrammatic drawings in which:

FIGS. 1*a* and 1*b* show carton blanks according to the invention,

Figure 4A:
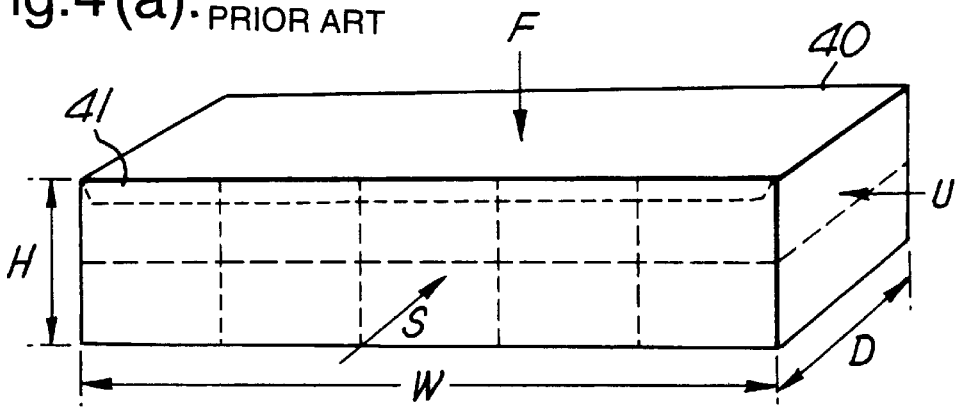
Fig.4(a). PRIOR ART
Figure 4B:
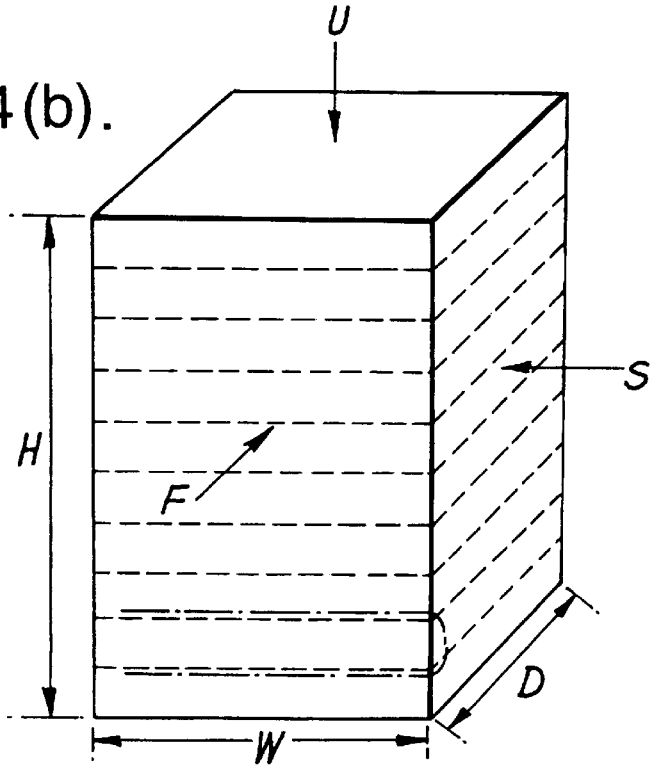
Figure 5:
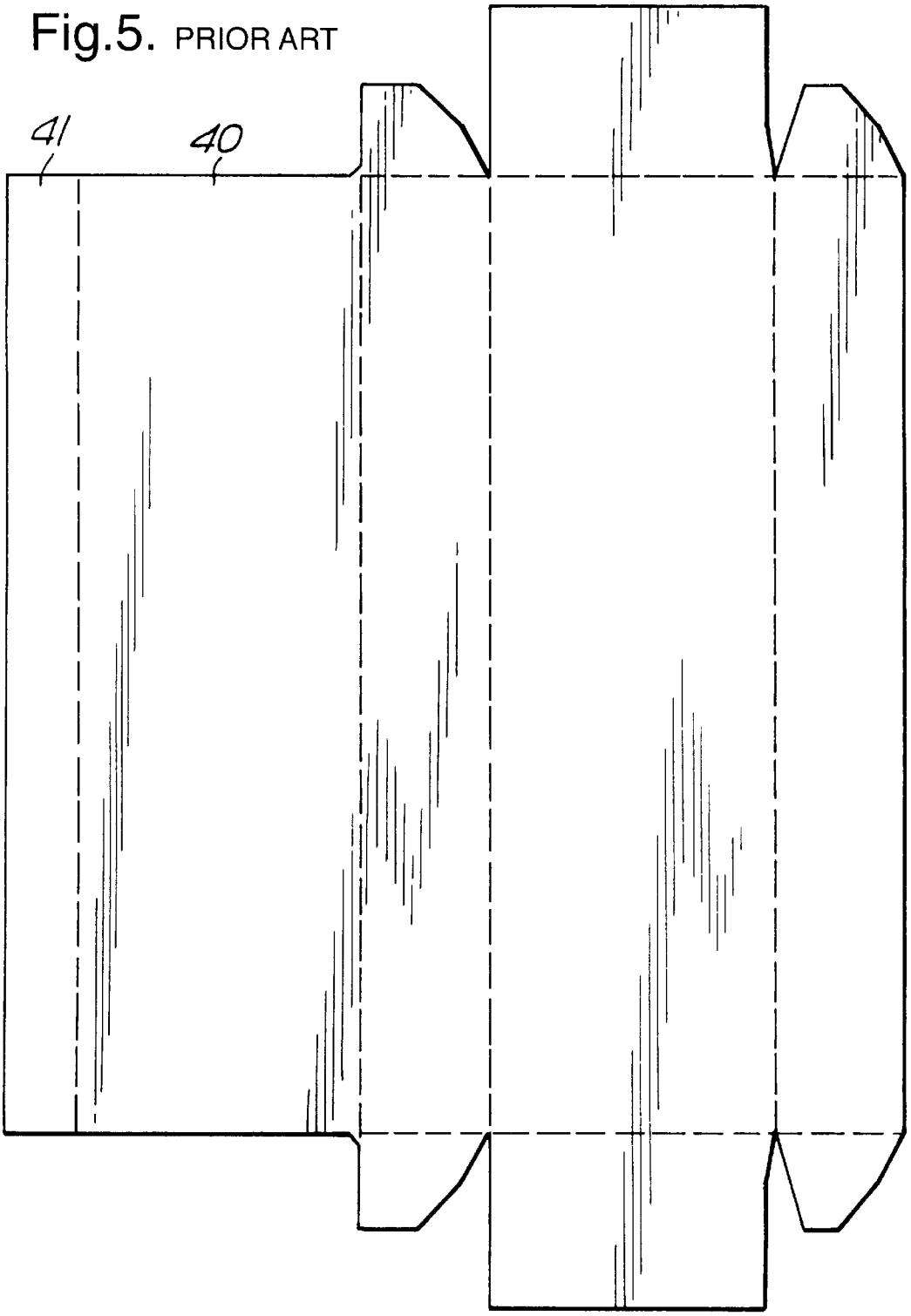
Fig.5. PRIOR ART

FIG. 4*a* shows a prior art carton and FIG. 4*b* shows a carton produced from a blank according to the invention, the pack arrangement within each carton also being depicted in faint lines, and FIG. 5 shows the blank for the prior art carton.

Figure 1A:
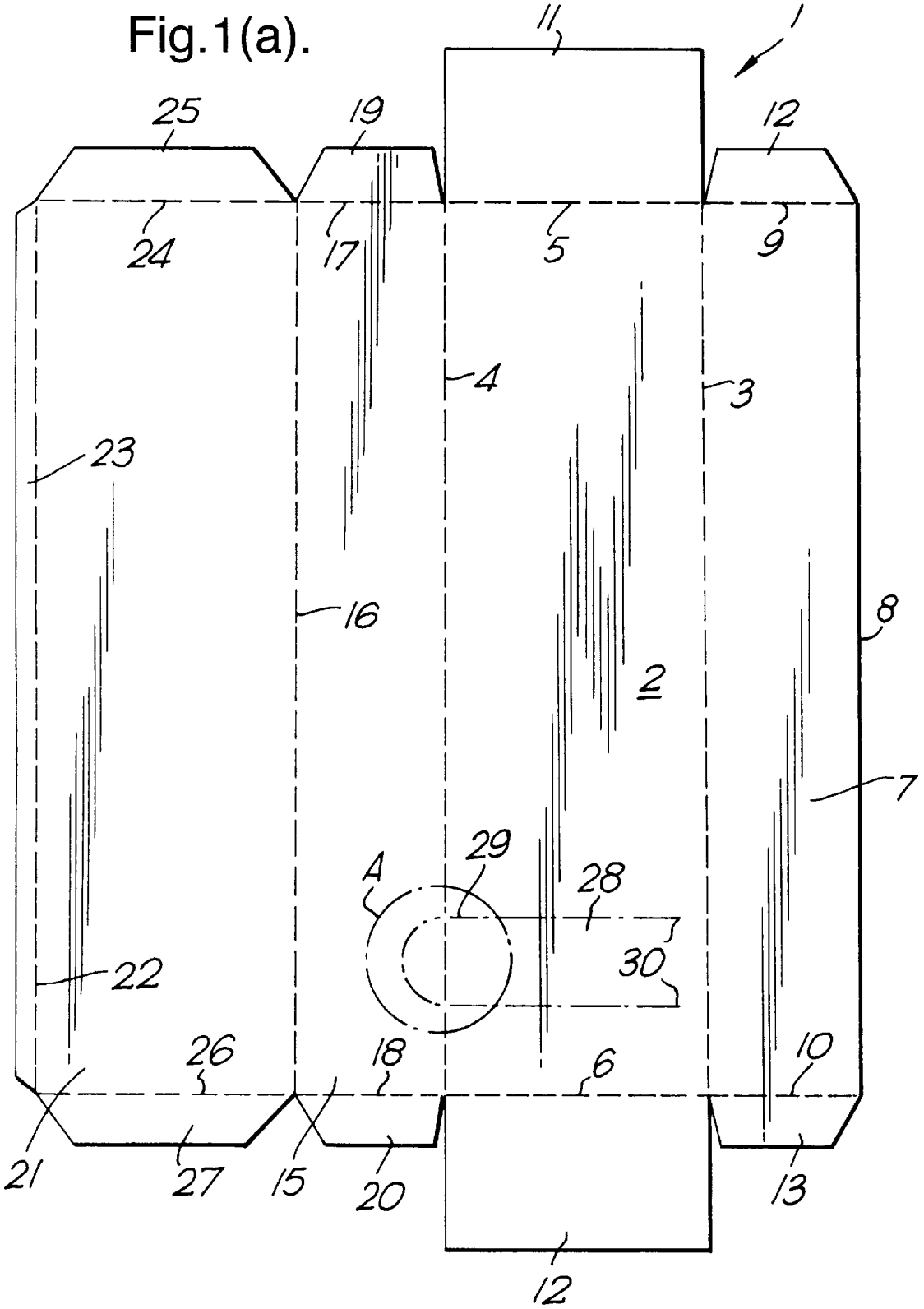

FIG. 1*a* shows a carton blank 1 for enclosing a number of packs of cigarettes. Usually the packs will each contain twenty cigarettes of 84 mm length and 24.75 mm circumference and there will be ten packs of cigarettes within the carton. Ten packs of cigarettes are advantageously arranged in a face to face stack to provide a rectangular block. The length of the longitudinal axis of the block provides the length of the longitudinal axis of the carton blank. The top and bottom width dimensions of the packs provide the width of the side panels.

The carton blank 1 comprises a first panel 2 having two longitudinal side margins 3 and 4 respectively, a top margin 5 and a bottom margin 6. Depending from longitudinal side margin 3 is a first side panel 7 having a longitudinal cut edge 8, a top margin 9 and a bottom margin 10. Depending from top margin 5 of first panel 2 is outer top flap 11. Depending from bottom margin 6 of first panel 2 is outer bottom flap 12. Depending from top margin 9 of the first side panel 7 is top inner flap 13 and depending from bottom margin 10 of first side panel 7 is bottom inner flap 14.

Depending from longitudinal side margin 4 of first panel 2 is a second side panel 15 which has a further longitudinal side margin 16, a top margin 17 and a bottom margin 18. Depending from top margin 17 is top inner flap 19 and a bottom inner flap 20.

Second panel 21 depends from longitudinal side margin 16 of the second side panel 15. A side flap 23 depends from the other longitudinal side margin 22 of second panel 21. An outer top flap 25 depends from top margin 24 of second panel 21. An outer bottom flap 27 depends from bottom margin 26 of second panel 21.

Figure 1B:
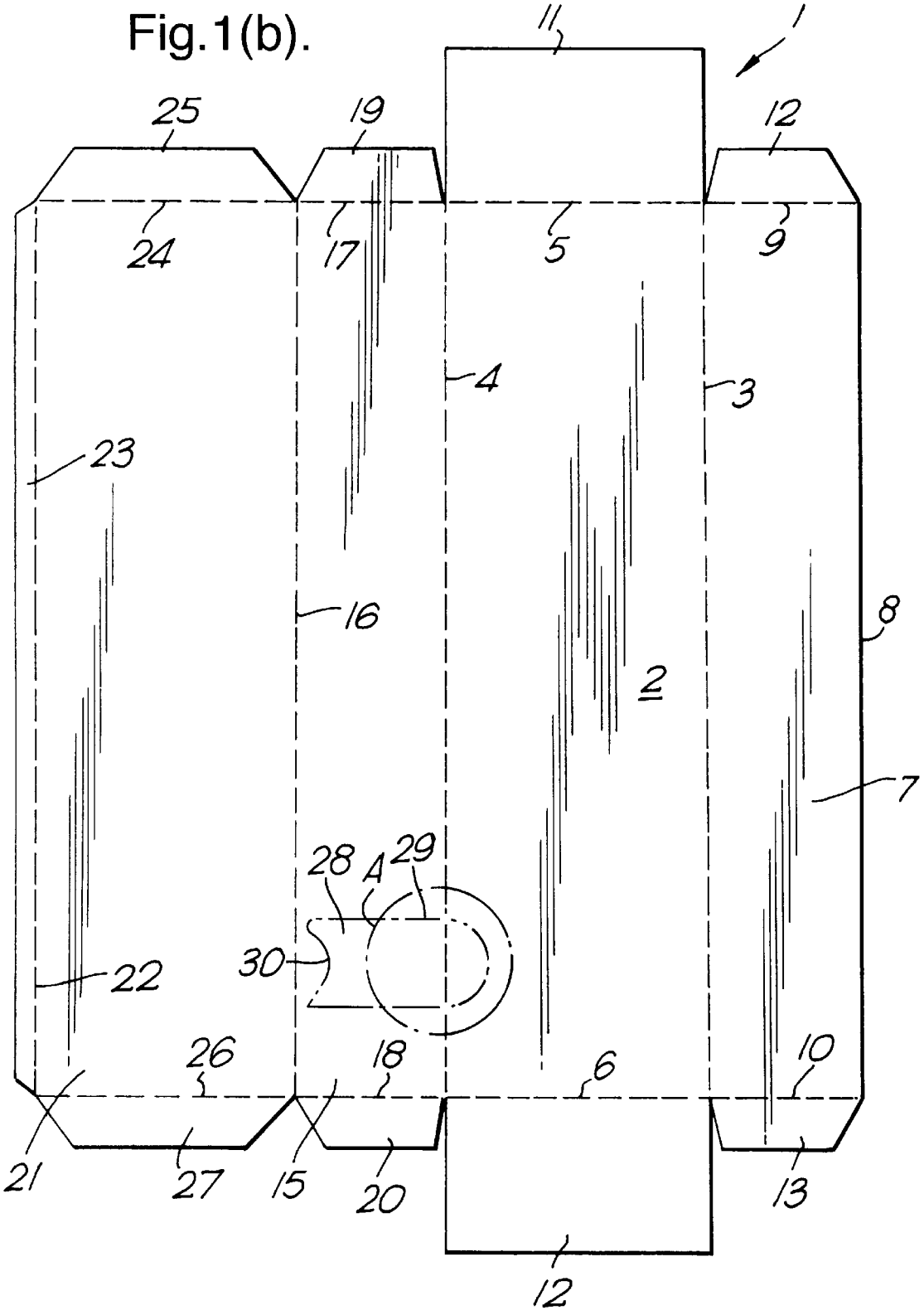
Figure 2:
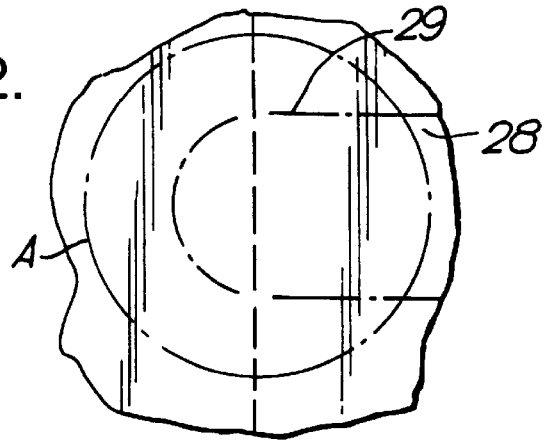
FIG. 2 shows an enlargement A of part of the dispensing portion.

In first panel 2 there is provided the major part of a dispensing portion 28 defined by a perforation line 29. The dispensing portion starts from a position 30 short of one of the longitudinal side margins of first panel 2, in this case longitudinal side margin 3, and extends across first panel 2 through the other longitudinal side margin 4 into side panel 15. This arrangement of the dispensing portion provides increased strength over a carton having a dispensing portion which extends across two longitudinal margins into a further side panel. Furthermore, the particular perforation arrangement of the perforation line can be preferably selected to ensure that, unlike prior art cigarette cartons with dispensing portions which extend across two longitudinal margins, there is no cut in the cartonboard through the longitudinal margin. This particularly preferred embodiment can be seen in the enlarged view shown in FIG. 2. FIG. 1(*b*) shows an alternate embodiment with the dispensing portion located on the side panel of the carton.

Figure 3:
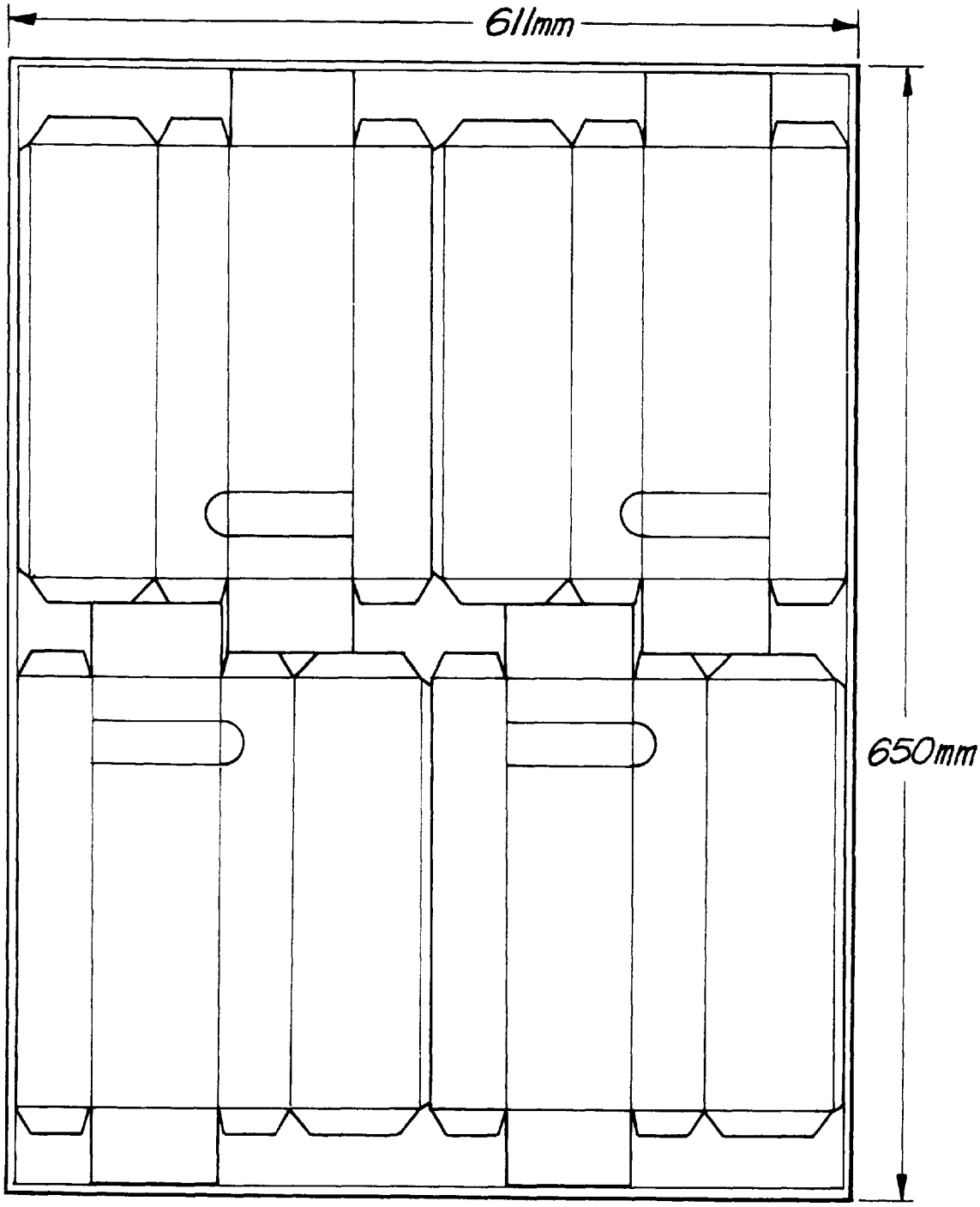
FIG. 3 shows a print layout for a carton blank according to the invention.

FIG. 3 shows the print layout for a carton blank according to the invention. The nested arrangement depicted provides an 11.7% saving in carton board area for the Lemanic 650 mm print layout over the nested print layout for a conventional carton blank for an 84 mm long, 24.75 mm circumference product (illustrated in FIG. 5) over the same 650 mm width of Lemanic print layout.

EXAMPLE 1

In a test to determine the increase in strength, if any, of a carton made from a blank according to the invention a control standard 200's carton was used, this being the carton produced in Applicant's Southampton factory in the U.K. The control standard 200's carton contains two rows of five columns of cigarette packs. This carton is known herein as the 200's standard compact carton. The carton according to the invention contained ten cigarette packs stacked in face-to-face relationship. The two cartons are shown in FIGS. 4*a* and 4*b* respectively.

The prior art blank for the standard carton used is illustrated in FIG. 5. The top panel 40 has no side flaps but does have a fold-in flap 41. The longitudinal dimension of the carton is very different because of the 5×2 layout of packs therein and there is no dispensing portion. The fold-in flap 41 of top panel 40 is not normally glued, as the 200's standard compact carton is overwrapped with film. In these tests the measurements made for both cartons are without overwrap, as machine overwrapping of the inventive cartons was not available. The fold-in flap 41 of the prior art 200's standard compact carton is not glued, as usual. The carton made from the inventive blank is normally supplied flat with side flap (23 in FIG. 1) glued against the inside of side panel 7. A standard cigarette pack, when erected, has the following dimensions for a 84 mm long, 24.75 mm circumference product: height(H) 87.5 mm; width(W) 58.5 mm and depth (D) 23 mm. In a five column, two row orientation the dimensions of the prior art carton are bigger than the new carton for ten packs stacked face to face.

Prior art carton dimensions (as identified in FIG. 4*a*) for the same 84 mm product are: H 47 mm; W 294 mm; D 87 mm. The carton of the present invention, when erected, has the following dimensions: H 221 mm; W 87.5 mm; D 57.5 mm.

Also indicated in FIGS. 4*a* and 4*b* is the direction of compression applied to the carton when the carton is lying on the face opposite to that face at which the force arrow is pointing. Thus, for example, in the prior art carton, the 'flat' measurement is made when the carton is standing on the opposite face to that which the arrow F is pointing, i.e. the carton is positioned as shown in the Figure. The compression measurement was carried out using a Laboratory Instron Tensometer. The force measured is in Newtons. The measurements are shown in Table 1 below. The board for both cartons is 230 g/m$^2$.

TABLE 1

| | 200's Compression Value (N) | | |
|---|---|---|---|
| Variant | Upright | Side | Front |
| Carton 1 (200's Standard compact carton, no dispensing portion) | 394 | 243 | 228 |
| Carton 2 (new carton with dispensing portion, not cut across margin) | 463 | 294 | 283 |

The ratio of Carton 2 divided by Carton 1 shows the total improvement in strength gained by changing the stacking arrangement, having a glued margin in Carton 2 but not in Carton 1, and the effect of having a dispensing portion in the carton, which dispensing portion extends over only one longitudinal margin. This ratio is shown in Table 2 below.

TABLE 2

| Variant | Improvements over Carton 1 | | | | |
|---|---|---|---|---|---|
| | Upright | Side | Front | Total | % Improvement |
| Carton 1 | 1 | 1 | 1 | 3.0 | — |
| Carton 2 | 1.17 | 1.21 | 1.23 | 3.61 | 20% |

There is thus a very significant improvement in strength going from prior art cartons to cartons according to the invention.

In order to show the effect achieved particularly by the perforation line of the dispensing portion used in the blank according to the invention over known prior art dispensing portions in which the perforation line extends across two longitudinal margins, the following tests were carried out as exemplified in Example 2.

EXAMPLE 2

In this second test series, owing to refurbishment at the time the tests were carried out, a new carton from a carton blank according to the invention and filled with packs containing cigarettes was not available. Therefore, a 200's standard compact carton (no dispensing portion) filled with packs containing filter rods was produced. This carton is known as Carton 4 in Table 1 below. This carton was measured at the same time as a carton provided from a carton blank according to one embodiment of the invention, i.e. with a dispensing portion in a front panel extending across only one longitudinal margin and cut across the margin, which carton was also filled with filter rods. These cartons are known as Carton 5 in Table 3 below. To provide a correction factor to convert the measurement to a carton filled with cigarettes, a 200's standard compact carton (no dispensing portion) filled with packs of cigarettes were measured. These cartons are known as Carton 3 in Table 3 below.

The measurements for these cartons are shown in Table 3 below. All measurements were made using 230 g/m$^2$ board for both the 20's cigarette packs and 200's cartons.

TABLE 3

| Variant | 200's Compression Value (N) | | |
|---|---|---|---|
| | Upright | Side | Front |
| Carton 3 - cigarettes (standard compact carton, no dispensing portion) | 413 | 246 | 221 |
| Carton 4 - filter rods (standard compact carton, no dispensing portion) | 405 | 414 | 287 |
| Correction factor | 1.02 | 0.59 | 0.77 |
| Carton 5 - filter rods (new carton with dispensing portion, cut across margin) | 530 | 473 | 279 |
| Carton 5C (corrected Carton 5 with cigarettes) | 541 | 279 | 215 |

From the results, comparisons can be made of the strength improvement gained by not cutting across the margin through which the perforation line passes. The strength improvement gained over a 200's standard compact carton by providing a dispensing portion, even though cut across the one margin through which the perforation line extends, can be observed by dividing the value for Carton 5C by the value for Carton 3.

These values are shown in Table 4 below.

TABLE 4

| | Improvements over Carton 1 | | | | |
|---|---|---|---|---|---|
| | Upright | Side | Front | Total | % Improvement |
| Carton 3 | 1 | 1 | 1 | 3.0 | — |
| Carton 5C | 1.31 | 1.13 | 0.97 | 3.41 | 14% |

There is thus a 14% improvement in strength from cartons made with the different stacking arrangements, dispensing portion and the glue arrangement from 200's standard compact carton.

In order to compare the improvement of Carton 2 over Carton 5C, in other words to determine the effect solely attributable to not cutting through the one longitudinal margin through which the perforation line of the dispensing portion extends, the values of Carton 5C for each margin should be divided throughout for both Carton 5C (to bring Carton 5C to unity) and Carton 2. The results are shown in Table 5.

TABLE 5

| | Improvements over Carton 5C | | | | |
|---|---|---|---|---|---|
| | Upright | Side | Front | Total | % Improvement |
| Carton 5C | 1 | 1 | 1 | 3.0 | — |
| Carton 2 | 0.86 | 1.05 | 1.32 | 3.23 | 7.7 |

From Table 5 it can be seen that Carton 2, which has a perforation line of the dispensing portion specifically designed not to cut the longitudinal margin, has a 7.7% improved strength over a carton having a dispensing portion across one longitudinal margin the perforation line of which cuts the margin.

As a result of the 20% increase in strength shown by the inventive carton layout over the original carton layout, for the 84 mm cigarette described as an illustration there can be a downweighting in the board used to pack the 20's cigarettes. This board is usually a premium packaging material, i.e. non-recycled, in order to give maximum protection to the product. A downweighting from 230 g/m$^2$ board to a 215 g/m$^2$ provides not only a saving in cost for the reduced board weight, but also a reduction in pack dimensions, when erected, because of the thinner board used. There is thus also obtainable a reduction in the size of carton.

Thus, not only does the improved strength of the inventive carton allow for a reduction in the cost of material as a result of using lower cost re-cycled board as the carton board, but a size reduction can be made in the cigarette 20's packs because of the downweighted board therefor. This also allows the carton size to be decreased which provides a consequent reduction in material cost. The carton dimensions before size reduction would have been: H 58.5 mm; W 235 mm; D 87.5 mm. The proposed carton dimensions are given in Example 1, in contrast. As the film overwrap adds strength to the carton, further cartonboard downweighting can be achieved, giving additional cost reduction.

As a consequence of the reduction in carton size the case, in which the 200's cartons are packed, is also reduced. This gives further materials saving in carton board and, therefore, cost reduction. The reduction in size of the case gives an overall improvement in strength, and hence the board material for the case can be downweighted to give the same strength as the original case. The reduced case size allows the manufacturer to put more cases on the same transporter, which reduces distribution costs. Thus, there can readily be seen that from the modification of the carton obtained by a revised stacking arrangement of the cigarette packs therein and the improved dispensing portion and perforation line, there are obtained substantial monetary savings without loss of packaging strength and product protection. The improvement of the dispensing portion only extending across one margin and the added advantages of the enhanced perforation line allows the manufacturer to optimise the monetary savings. The manufacturer can thus achieve the prime objective of the EC directive, namely to use the least material in product packaging and also a secondary objective of increasing the amount of recycled material in product packaging. As an example of the monetary cost saving, for the particular 84 mm filter cigarette product tested, a total saving of about £5 million can be made for a volume of 30 billion cigarettes.

This method of perforation cutting to provide a dispensing portion over one or more panels can be used in packaging other than for smoking articles, with similar opportunity for cost savings.

I claim:

1. A carton containing smoking article packs, which carton is formed from a blank comprising a first panel, a second panel, a first side panel, a second side panel, a side flap, and inner and outer top and bottom flaps, said panels being defined longitudinally by two longitudinal side margins, wherein there is provided a dispensing portion in said carton, which dispensing portion extends from a position less than about 5 mm short of one of the longitudinal side margins of one panel across the respective panel through the other longitudinal side margin of that panel into another panel and provides an opening in said carton, said dispensing portion being defined by perforations said perforations extending into said another panel without said other longitudinal margin having perforations thereacross, wherein said dispensing portion is dimensioned such that one of said smoking article pack stacked with said other packs in the carton in a face-to-face arrangement in a single stack can be removed easily from said stack via the opening provided by said dispensing portion, said opening being not substantially greater than the side dimension of said one pack when said dispensing portion is open.

2. A carton according to claim 1, wherein each of said panels of said blank of said carton has a top margin and a bottom margin.

3. A carton according to claim 1, wherein said first side panel of said blank of said carton depends from one of the longitudinal side margins of said first panel.

4. A carton according to claim 3, wherein said second side panel of said blank of said carton depends from the other longitudinal side margin of said first panel.

5. A carton according to claim 4, wherein said second panel of said blank of said carton depends from the further longitudinal side margin of said second side panel.

6. A carton according to claim 5, wherein said side flap of said blank of said carton depends from the other longitudinal side margin of said second panel.

7. A carton according to claim 1, wherein said first and second side panels of said blank of said carton depends from each of the longitudinal side margins of said first panel.

8. A carton according to claim 7, wherein one of said side panels depends from a longitudinal side margin of said second panel.

9. A carton according to claim 8, wherein said side flap of said blank of said carton depends from the other longitudinal side margin of said second panel.

10. A carton according to claim 1, wherein said dispensing portion is located mainly in said first panel of said blank of said carton.

11. A carton according to claim 1, wherein said dispensing portion is located mainly in one of said panels of said blank of said carton.

12. A carton according to claim 1, wherein said perforations across said longitudinal margin of said blank of said carton stops less than 5 mm from either side of said margin.

13. A carton according to claim 12, wherein said perforations across said longitudinal margin of said blank of said carton stops less than 3 mm from either side of said margin.

14. A carton according to claim 1, wherein the cartonboard of said carton is recycled board product.

15. A carton according to claim 1, wherein said dispensing portion is located mainly in said second panel of said blank of said carton.

16. A carton according to claim 1, wherein the outer top flap and/or the outer bottom flap of said blank of said carton are each located depending from the top margin and bottom margin respectively of said first panel.

17. A carton according to claim 16, wherein a top inner flap and a bottom inner flap of said blank of said carton depends from each of the remaining respective top and bottom margins of said blank.

18. A carton print layout for said blank of a carton, according to claim 1, wherein each of said carton blanks, when erected, contains smoking article packs in a face-to-face stacked arrangement thereby providing a reduced carton blank surface area as compared with a 200's standard compact carton, said carton blanks being in an arrangement in said print layout such that said arrangement of said carton blanks in said print layout and said reduced carton blank surface area provides more than 10% saving in board area over the 200's standard compact carton blank surface area and print layout provided for an 84 mm long, 24.75 mm circumference smoking article.

19. A carton print layout according to claim 18, wherein the arrangement of said carton blanks in said print layout and said reduced carton blank surface area provides a saving of more than 11% on board area of the print layout.

20. A carton print layout according to claim 19, wherein the saving is about 11.7% in board area over a 200's standard compact carton.

21. A carton according to claim 1 wherein said carton has an improved strength and contains smoking article packs formed from cartonboard and as a consequence of said improved strength of said carton, said cartonboard of said packs may be of a reduced board weight.

* * * * *